United States Patent [19]

Hoke et al.

[11] Patent Number: 4,472,769

[45] Date of Patent: Sep. 18, 1984

[54] ADJUSTABLE LAMP SOCKET WITH CYLINDRICAL SHIELD

[75] Inventors: Merle C. Hoke; Richard G. Armstrong, both of Newark, Ohio

[73] Assignee: Manville Service Corporation, Denver, Colo.

[21] Appl. No.: 400,333

[22] Filed: Jul. 21, 1982

[51] Int. Cl.[3] ..... F21V 21/36

[52] U.S. Cl. ..... 362/403; 362/285; 362/429; 362/430

[58] Field of Search ..... 362/217, 225, 296, 370, 362/371, 285, 403, 404, 418, 430, 220, 289, 429, 458

[56] References Cited

U.S. PATENT DOCUMENTS

| | | | |
|---|---|---|---|
| 1,282,676 | 10/1918 | Carlin | 362/396 |
| 1,916,048 | 6/1933 | Guett | 362/418 |
| 2,166,394 | 7/1939 | Crossley | 362/371 |
| 4,173,037 | 10/1979 | Henderson, Jr. et al. | 362/429 X |
| 4,200,905 | 4/1980 | Shelby et al. | 362/396 |
| 4,232,361 | 11/1980 | Kelsall | 362/404 X |
| 4,327,402 | 4/1982 | Aubrey | 362/404 X |
| 4,363,086 | 12/1982 | Fletcher | 362/371 X |

FOREIGN PATENT DOCUMENTS

| | | | |
|---|---|---|---|
| 7706375 | 4/1978 | Netherlands | 362/396 |
| 1325427 | 8/1973 | United Kingdom | 362/371 |

*Primary Examiner*—Peter A. Nelson

*Attorney, Agent, or Firm*—Ronald M. Halvorsen; Cornelius P. Quinn; Timothy R. Schulte

[57] ABSTRACT

An improved luminar having an adjustable lamp socket is disclosed. The adjustable socket comprises a generally cylindrical shaped socket shield which is fixed to the ballast housing of the luminar and is positioned around the lamp socket with the socket shield having formed therein a bracket channel and a guide channel. A generally U-shaped bracket is fixedly attached to the socket and has identification means formed thereon designating the relative position of the socket within the socket shield. The bracket also has formed thereon at least one protuberance for positioning in the guide channel means formed on the socket shield. The generally U-shaped bracket is positioned within the bracket channel means and is designed for movement within the channel in the desired position of the lamp in the reflector of the luminar. Locking means are provided for locking the U-shaped bracket within the socket shield at the desired pre-determined position.

4 Claims, 11 Drawing Figures

ADJUSTABLE LAMP SOCKET WITH CYLINDRICAL SHIELD

BACKGROUND OF THE INVENTION

This invention relates generally to lamp sockets and more particularly to a new and improved adjustable lamp socket for use with ceiling, pendant or wall mounted high intensity discharge luminaires and the like.

In the mounting of high intensity discharge luminaires on a ceiling or wall of a factory or other large enclosure, it is desirable to be able to adjust the lamp socket so that the high intensity discharge lamp may be moved upwardly or downwardly a pre-determined amount. The purpose of the adjustment is to be able to obtain a proper light distribution by having the proper light center for different mounting heights of the luminaire and to accommodate different reflectors on the luminaire. By adjusting the lamp socket upwardly or downwardly, a proper lighting ratio or Spacing Criterion, may be obtained depending upon a given reflector.

Adjustability in the position of the lamp and lamp socket has been achieved in prior art devices through a variety of ways. One way would utilize the positioning of removable spacers or shims in the socket structure in order to achieve the desired position. Another method would employ the use of a step outer casting with an inner socket being rotated in the casting and locked in place at the desired position on the casting steps. Still another type of socket adjustment would utilize an elongated notch having a set screw positioned in the notch with the socket being adjustable throughout the length of the elongated notch and being held in place by the set screw.

SUMMARY OF THE INVENTION

In order to overcome problems that may be inherent in the various prior art socket adjustment methods hereinbefore described, there has been provided by the applicant's invention a new and improved adjustable lamp socket comprising a generally cylindrical shaped socket shield which is positioned around the lamp socket and has formed therein bracket channels and guide channels designed to receive a generally U-shaped bracket. The U-shaped bracket is positioned to slide in the bracket channel and has protuberances which are positioned in the guide channel and would serve to guide the bracket as it is adjusted.

Locking means are provided to lock the U-shaped bracket in the bracket channel and in the preferred embodiment described hereinafter the U-shaped bracket contains identification means designating a relative position of the socket within the socket shield. With the use of the identification means in combination with the guide and bracket channels, the socket may be quickly adjusted to a pre-determined position in the socket shield and may be quickly locked into place. The socket shield is fixedly attached to the under side of the ballast housing when the adjustable socket is used with a high intensity discharge type lamp having a ballast housing.

Accordingly it is an object and advantage of the invention to provide a new and improved adjustable lamp socket which allows close precise adjustment of the socket within given distance limits and which is manufactured with relatively few parts thereby minimizing maintenance problems and other problems associated with prior art type devices.

These and other objects and advantages of the invention will become apparent from a review of the drawings showing the preferred embodiment and from a study of the preferred embodiment to be hereinafter described.

BRIEF DESCRIPTION OF THE DRAWINGS

FIG. 8 is an enlarged section of one side of the socket shield showing in greater detail the bracket channel and the guide channel and showing also the positioning of the protuberances formed on the U-shaped bracket and how they slide in the guide channel;

DESCRIPTION OF THE PREFERRED EMBODIMENT

Figure 1:
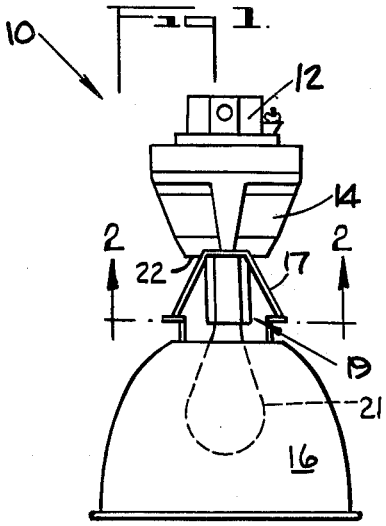
FIG. 1 is a side view of a Applicant's adjustable lamp socket as mounted in a typical high intensity discharge luminaire.

Referring now to the drawings in general and in particular to FIG. 1 of the drawings there is shown a typical high intensity discharge luminaire by the numeral 10 which comprises an upper mounting section 12 for mounting the luminaire to a ceiling, pendant conduit or a side wall. A ballast section 14 is fixedly attached to the mounting section 12 and acts as a heat sink for the ballast in addition to being the receptacle for containing the electrical ballast. A reflector 16 is fixedly attached to the ballast section by means of a curved rod 17 as is known in the art.

The Applicant's new and novel adjustable lamp socket is shown generally by the numeral 19 and is positioned in proximity to the reflector 16 and is fixedly attached to the under side of the ballast section 14. The adjustable socket 19 is designed to allow the lamp 21 which is positioned within the socket 19 and within the reflector 16 to be adjusted upwardly or downwardly within a pre-determined distance for the purposes to be described more fully hereinafter.

Figure 3:
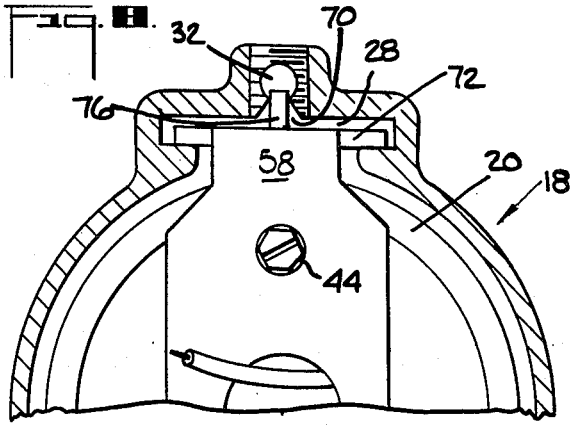
FIG. 3 is a plan view of the Applicant's cylindrical shaped socket shield guide used with his adjustable lamp socket showing in greater detail the bracket channel and the guide channel formed on each side of the shield as would be utilized in the preferred embodiment.

The Applicant's adjustable lamp socket comprises a generally cylindrical shaped socket shield, shown generally by the numeral 18 in FIG. 3 which is positioned around the lamp socket 20 and is fixedly attached to the lower most portion of the ballast section 14. The lower most portion of the ballast section 14 has been designated in the claims of the Applicant's invention as a frame and is shown by the numeral 22 in FIG. 2 of the drawings. The frame portion 22 is basically the flat bottom surface of the ballast section 14 upon which the socket shield 18 may be mounted as will be described more fully hereinafter.

Figure 4:
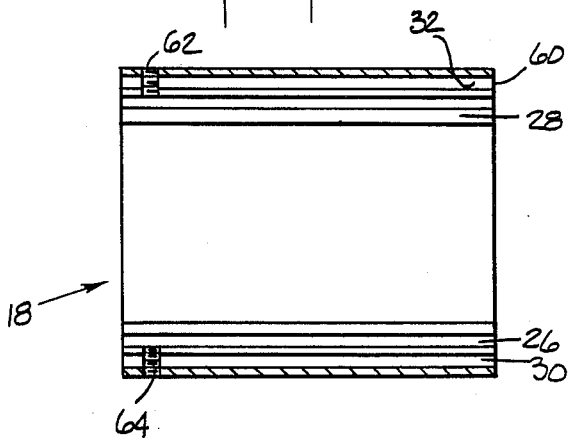
FIG. 4 is a sectional view, taken along line 4—4 of FIG. 3, showing in greater detail the guide channel and bracket channel of the Applicant's socket shield and further showing the drilled and tapped holes formed in the socket shield for receiving the locking means of the invention.

Referring now in detail to FIGS. 3 and 4 of the drawings there shown the socket shield 18 which is formed in a generally cylindrical shape and has formed therein a pair of bracket channels 26 and 28 in the preferred embodiment shown. The bracket channels 26 and 28 are formed in a generally rectangular shaped configuration on opposite sides of the socket shield as can be seen in FIG. 3 of the drawings. The bracket channels are designed to receive the oppositely spaced legs of the U-shaped bracket shown in FIG. 10 of the drawing as will be described more fully hereinafter. The socket shield 18 also has formed thereon a pair of guide channels 30 and 32 in the preferred embodiment shown. The guide channels are generally cylindrical elongated channels which are formed on opposite sides of the socket shield and are opened up into the bracket channels 26 and 28 as can be seen more clearly in FIG. 8 of the drawings.

Figure 2:
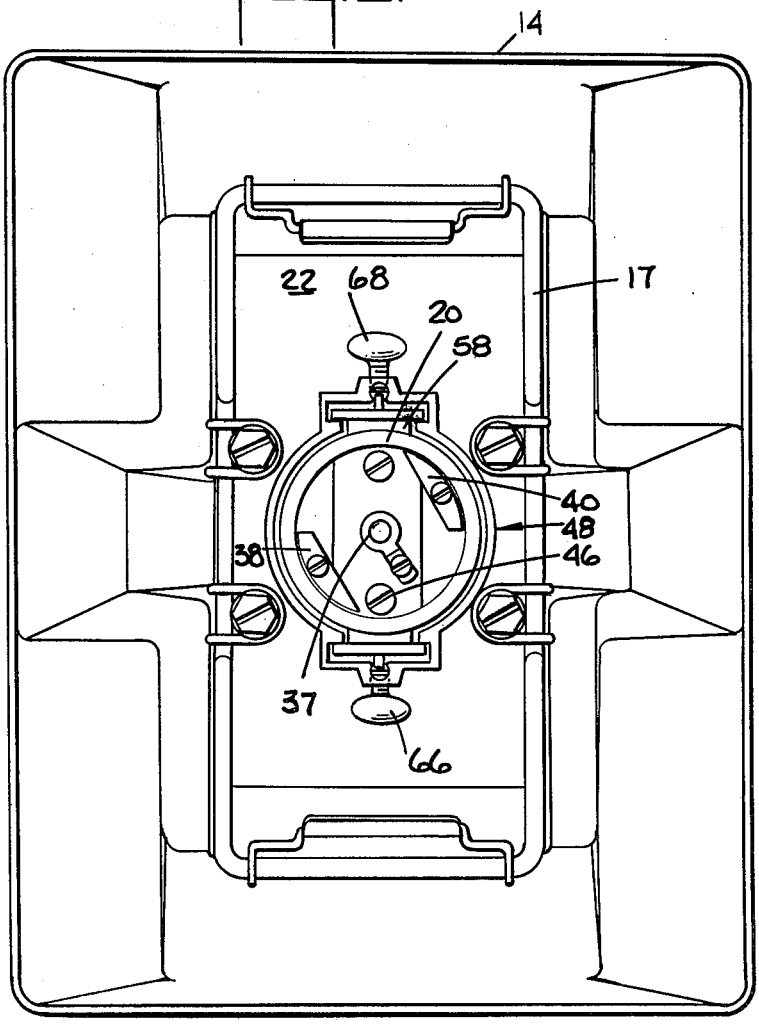
FIG. 2 is a bottom view, taken along line 2—2 of FIG. 1 showing the Applicant's adjustable lamp socket positioned in the cylindrical shaped socket shield and further showing the U-shaped bracket and the locking means for locking the U-shaped bracket within the socket shield.
Figure 3:
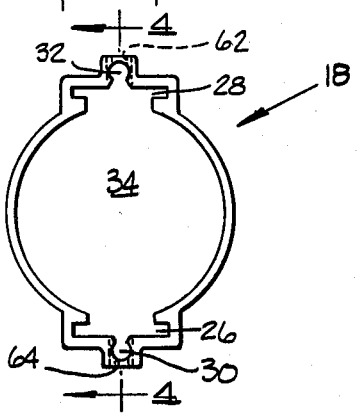

The socket shield 18 would have positioned in the central portion 34 the socket 20 as can be seen more clearly in FIG. 2 of the drawings. The socket 20 would be a typical screw-in type electrical socket design for receiving a screw-in base of a high intensity discharge lamp and would contain the necessary electrical connection 37 for electrically connecting the base of the high intensity discharge lamp as is known in the art. The socket 20 would also contain the necessary electrical parts 38 and 40 and other parts unnumbered and connected thereto for electrically connecting the remaining portion of the socket as it is know in the art.

Referring now to FIG. 4 of the drawing, the socket shield 18 contains a bottom edge 60 which is positioned against the frame 22 as shown in FIG. 2 of the drawings and would be fixedly attached to the frame 22 by means of a pair of self-tapping screws. The self-tapping screws would be positioned through holes in the frame 22 in the vicinity of the bracket channel 26 and 28. The self-tapping screws are not shown in the drawing but would be positioned so that they would be inserted within the guide channels 30 and 32 in order to tightly position the bottom edge 60 of the socket shield 18 against the frame 22. It is within the spirit and scope of the invention that other means may be utilized to fix the socket shield 18 to the frame 22 of the ballast section 14 without departing from the spirit and scope of the invention.

The socket shield 18 also has formed therein at least one drilled and tapped hole 62 in the position shown in FIG. 4 of the drawings. In the prefered embodiment there is also formed a second drilled and tapped hole 64, these holes being designed to receive a thumb screw 66 and 68 for locking the U-shaped bracket 56 and its attached socket 20 in a pre-determined position in the bracket channels 26 and 28. The thumb screw 66 and 68 would comprise the locking means of the Applicant's invention and it is within the spirit and scope of the invention that other locking means may also be utilized to lock the respective parts together.

The socket shield 18 may be formed in the preferred embodiment of an extruded aluminum alloy and would be finished in a natural finish having various tolerances suitable for extrusion as per commercial standards. By referring to FIG. 8 of the drawing, there can be seen an enlarged section of one side of the socket shield 18 showing in greater detail the positioning of the bracket channels 26 and 28 and the guide channels 30 and 32 of the Applicant's invention. There can be seen in FIG. 8 how the guide channels 30 and 32 are opened up to the bracket channels 26 and 28 by means of the angular section 70 which is designed to receive the protuberances formed on the U-shaped bracket as will be more fully described hereinafter. It should also be noted that the cylindrical shaped portion of the guide means 32 is designed to receive the self-tapping screws to firmly lock the socket shield 18 to the frame 22 as has been mentioned hereinbefore.

Figure 9:
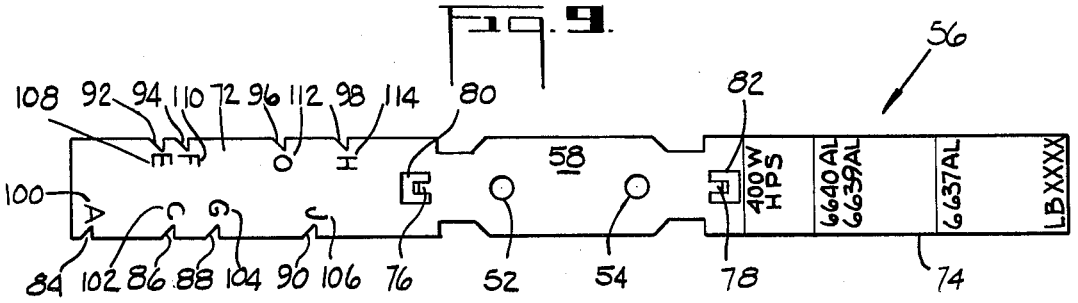
FIG. 9 is a plan view of the production blank for the U-shaped bracket showing a plurality of notches and the identification means formed on one side of the bracket for identifying the position of the U-shaped bracket in the socket shield and showing the alternate "Peel and Stick" label applied to the other side of the bracket.
Figure 10:
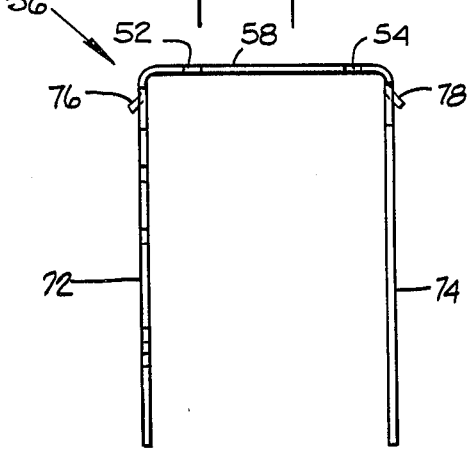
FIG. 10 is a side view of the bracket shown in FIG. 9 showing it bent into its U-shaped position as it would be formed and inserted into the guide channels of the socket shield.
Figure 11:
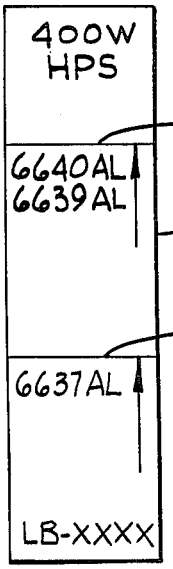
FIG. 11 is a plan view of a "Peel and Stick" label which could be used as an alternate means of marking the U-shaped bracket 56 shown in FIG. 9 and would be applied as an alternate marking means to the leg 74 on the other side of the bracket shown in FIG. 9.

Referring now to FIGS. 9–11 of the drawing, there will be shown in greater detail the U-shaped bracket 56 and the identification means formed thereon for designating the relative position of the socket within the socket shield. FIG. 11 shows an alternate identification means which will also be described hereinafter. The U-shaped bracket 56 contains a central section 58 and two spaced apart legs 72 and 74. The legs 72 and 74 contain protuberances 76 and 78 formed from a cut out notch 80 and 82 and bent outwardly therefrom at a pre-determined angle. The protuberances 76 and 78 are then designed to ride within the angular section 70 formed in the guide channels 30 and 32 as shown more clearly in FIG. 8 of the drawing. These protuberances 76 and 78 then serve to guide the U-shaped bracket 56 within the bracket channels 26 and 28 as the legs 72 and 74 ride within the guide channels 30 and 32.

In the preferred embodiment a plurality of notches 84, 86, 88 and 90 may be formed on one side of the leg 72 and a plurality of notches 92, 94, 96 and 98 may be formed on the other side of the leg 72. The U-shaped bracket 56 also contains identification means designating the relative position of the socket 20 within the socket shield 18. This identification means may comprise in the preferred embodiment a plurality of indicia 100, 102, 104, 106, 108, 110, 112 and 114. The indicia 100–114 would be positioned in proximity to the notches 84–98 and would be keyed to a code system related to various pre-determined positions of the adjustable socket in the reflector 16. It should then be apparent that whenever the U-shaped bracket 56 is moved within the socket shield 18 that the thumb screws 66 and 68 could be tightened after the indicia 100–114 has appeared at a pre-determined sliding point thereby identifying that the socket 20 is correctly positioned within the reflector 16 at a pre-determined position to give desired light control ratios.

For example using the various indicia in FIG. 9 of the drawing positioned as shown, various ratios are able to be obtained which would then allow desired light centers to be obtained for different mounting heights using different reflectors. With the design herein incorporated in the preferred embodiment, it has been found that by using four different size reflectors 16 of the type manufactured by the Holophane Division of Manville Products Corporation, Denver, Col., ten different lighting ratios are obtainable for the lighting centers to be utilized for different mounting heights using different reflectors when a plurality of luminaires are positioned in a given area. An example of this adjustability is shown in the following chart which illustrates the lighting ratio variance at the different settings of the socket 20 when used with a given Holophane reflector:

| Identification Letter | Lighting Ratio | Holophane Reflector Number |
|---|---|---|
| A | 1.3/1 | #6635 |
| C | 0.7/1 | #6640 |
| G | 1.8/1 | #6637 |
| J | 1.3/1 | #6640 |
| J | 1.0/1 | #6639 |
| E | 1.6/1 | #6635 |
| F | 1.0/1 | #6640 |
| O | 2.0/1 | #6635 |
| H | 1.4/1 | #6639 |
| H | 1.1/1 | #6640 |

From the foregoing chart, it can be seen that the large variety of lighting ratios can be obtained for various reflector mounting heights as outlined in a Holophane standard brochure for the types of reflectors described in the chart. By the use of the identification means of the Applicant's invention in combination with the adjustability features of the adjustable socket, a quick and reliable means of changing the socket position is obtainable which feature has not been obtainable in prior art type devices.

Figure 6:
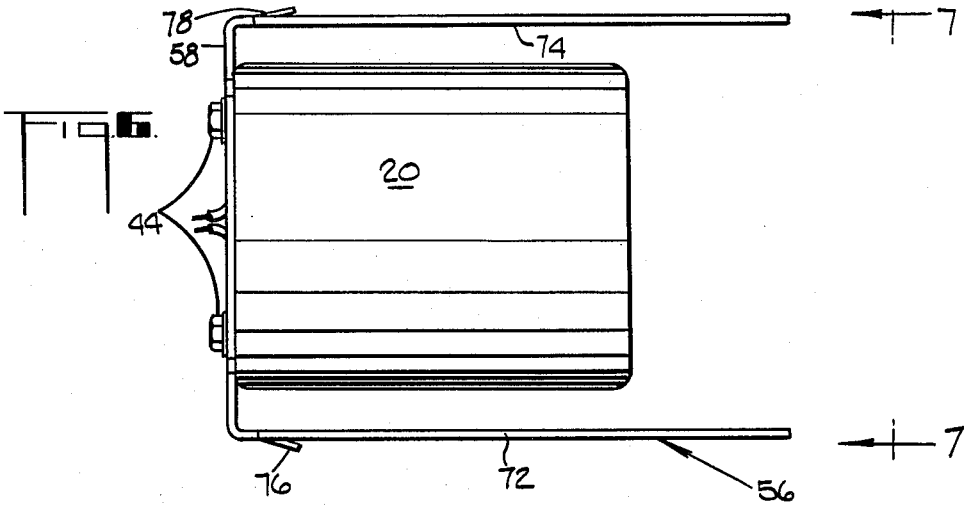
FIG. 6 is another side view, taken along line 6—6 of FIG. 5, showing in further detail the mounting of the U-shaped bracket on the socket and showing the protuberances 76 and 78 shown on the U-shaped bracket for puposes that will be described hereinafter.
Figure 5:
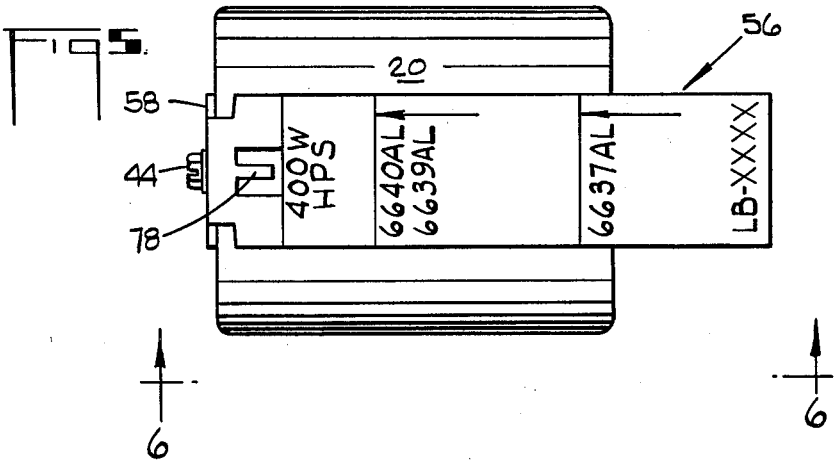
FIG. 5 is a side view of the lamp socket showing the U-shaped bracket attached to the socket and further showing a "Peel and Stick" label which could be used as an alternate means of marking the U-shaped bracket 56.
Figure 7:
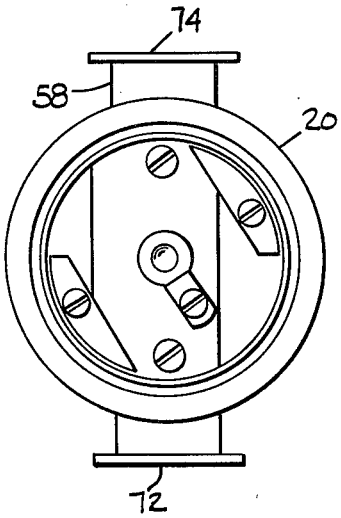
FIG. 7 is an end view taken along line 7—7 of FIG. 6 showing in further detail the positioning of the U-shaped bracket on the socket as utilized in the Applicant's adjustable lamp socket embodiment.

Referring now to FIG. 11 of the drawing there is shown a plan view of a "Peel and Stick" label which could be used as alternate means of identification marking the U-shaped bracket shown in FIG. 9 of the drawing. The "Peel and Stick" label 120 could be positioned on the other leg 74 of the U-shaped bracket 56 and would have a series of positioning lines 122 and 124 which would correspond to various settings of the adjustable lamp socket 20 when used in combination with the Holophane reflectors previously mentioned. The "Peel and Stick" label 120 shown in FIG. 11 and shown applied to the leg 74 in FIG. 9 could be used as an alternate to the notches 84–98 and indicia 100–114 shown on the other leg 72. The label 120 is shown applied to the leg 74 for convenience in drawing and would not necessarily be applied in addition to the use of the notches 84–98 and the indicia 100–114 Referring now to FIGS. 5–7 of the drawings there is shown in further detail how the U-shaped bracket is fixedly attached to the socket 20 prior to being positioned within the socket shield 18 as shown in FIG. 2 of the drawings. The U-shaped bracket 56 is firmly attached to the socket 20 by means of a pair of screws 44 which are positioned within matching holes 52 and 54 formed on the U-shaped bracket as can be seen in FIG. 9 of the drawings. When positioned thusly, it can be seen that the U-shaped bracket 56 would be positioned as shown in FIGS. 5–7 of the drawing with its legs 72 and 74 bent and formed around the socket 20 ready for insertion into the socket shield 18 so that the leg 72 and 74 would ride within the bracket channels 26 and 28 as shown in FIGS. 2 and 8 of the drawings. It can also be seen in FIGS. 5–7 of the drawings that the protuberances 76 and 78 formed on the bracket legs 72 and 74 would be positioned within the guide channels 30 and 32 to guide the U-shaped bracket 56 whenever it is moved within the socket shield.

There is also shown in FIG. 5 how the "Peel and Stick" label 120 could be applied to one of the legs 72 or 74 of the U-shaped bracket in a modification of the embodiment of the invention as has hereinbefore been described.

From the foregoing it can be seen that there has been provided by the applicant's invention a new and novel type adjustable lamp socket which may be utilized in high intensity discharge type luminaires and other type of luminaires. The Applicant's new and novel socket accomplishes all of the objects and advantages of the invention and it should become apparent from a review of the specification and a study of the drawings that changes may be made in the arrangement of parts and the structure of the various parts without departing from the spirit and scope of the invention which has been given by way of illustration only.

Having described our invention, we claim:

1. An adjustable lamp socket, comprising:

(a) a frame;

(b) a socket for receiving the lamp;

(c) a generally cylindrical shaped socket shield positioned around the socket and fixedly attached to the frame, the socket shield having formed therein two bracket channels longitudinally extending on opposite sides of said socket shield and also having formed therein two guide channels, each extending longitudinally adjacent a corresponding bracket channel;

(d) a generally U-shaped bracket including a central section and two leg portions, said central section fixedly attached to the socket, the U-shaped bracket further having at least one protuberance on each leg for positioning in a corresponding guide channel, each leg portion slidably positioned within the corresponding bracket channel for movement within the bracket channel to pre-determined positions;

(e) locking means, fixedly attached to the socket shield for locking said leg portions in said pre-determined positions in the bracket channel; and (f) identification means, on at least one of said leg portions, for designating the relative position of the socket within the socket shield.

2. The adjustable lamp socket as defined in claim 1, wherein the identification means includes a plurality of indicia, designating letters, which relate to various pre-determined positions of the adjustable socket.

3. The adjustable lamp socket as defined in claim 1, wherein the generally cylindrical shaped socket shield includes at least one drilled and tapped hole formed in the side thereof adjacent a bracket channel and further including one locking screw being positioned in each drilled and tapped hole.

4. The adjustable lamp socket as defined in claim 1, wherein the identification means includes a peel and stick label being adhered to the U-shaped bracket, the peel and stick label having formed thereon indicia designating various pre-determined positions of the adjustable socket.

* * * * *